US005551110A

United States Patent [19]

Armstrong et al.

[11] Patent Number: 5,551,110

[45] Date of Patent: Sep. 3, 1996

[54] COLLAPSIBLE SHADE FOR HEAD CHAIR

[75] Inventors: Jeffrey A. Armstrong, Woodinville; Roger L. Sortino, Bellevue, both of Wash.

[73] Assignee: Beachead Products Company, Kirkland, Wash.

[21] Appl. No.: 253,731

[22] Filed: Jun. 3, 1994

[51] Int. Cl.[6] ..... A47C 20/02; A47C 7/62

[52] U.S. Cl. ..... 5/656; 5/418; 297/184.15; 135/96; 135/121

[58] Field of Search ..... 297/184.15, 184.1; 135/96, 121, 17; 5/656, 418

[56] References Cited

U.S. PATENT DOCUMENTS

| | | | |
|---|---|---|---|
| 326,619 | 9/1885 | Baldwin | 297/184.15 |
| 1,746,833 | 2/1930 | Hermansen | 5/656 |
| 2,853,088 | 9/1958 | Lamborn | 5/418 |
| 3,243,230 | 3/1966 | Otto | 135/96 |
| 3,383,127 | 5/1968 | Grunfeld | 135/96 |
| 4,063,318 | 12/1977 | Nicholson | 135/96 |
| 4,100,633 | 7/1978 | Pintos | 135/96 |
| 4,544,203 | 10/1985 | Younger et al. | 297/391 |
| 4,635,667 | 1/1987 | Harn | 297/184.15 |
| 4,641,883 | 2/1987 | Kato | 297/184.15 |
| 5,096,257 | 3/1992 | Clark | 297/184.15 |
| 5,102,190 | 4/1992 | Akin et al. | 297/184.15 |

FOREIGN PATENT DOCUMENTS

| | | | |
|---|---|---|---|
| 2589702 | 5/1987 | France | 5/418 |
| 3209015 | 9/1983 | Germany | 5/418 |
| 707953 | 4/1954 | United Kingdom | 5/418 |
| 005543 | 12/1985 | WIPO | 297/184.15 |

OTHER PUBLICATIONS

Copy of promotion/box for Headchair II, date unknown, 2 pages.

*Primary Examiner*—Michael J. Milano
*Attorney, Agent, or Firm*—Christensen O'Connor; Johnson & Kindness PLLC

[57] ABSTRACT

A collapsible sunshade(50) includes a pair of support arms(54*a*, 54*b*). Disposed on outer ends of the support arms are a pair of ribs (62*a*, 62*b*). A fabric sheet (51) is disposed between the ribs to form a sunshade. The support arms include a pair of outwardly extending lever arms (58*a*, 58*b*). The ribs similarly include a pair of lever arms (64*a* and 64*b*). A pair of push rods (70*a*, 70*b*) extend between the lever arms of the support arms and the ribs. As the support arms are moved from a closed position in which they are substantially parallel to an open position in which they are substantially apart, the lever arms cause the ribs to extend outward thereby extending the shade. Preferably the sun shade is designed to be fitted on a collapsible headrest such that the combination of the collapsible shade and headrest can be easily stowed and transported by a user.

15 Claims, 8 Drawing Sheets

51
50
30

COLLAPSIBLE SHADE FOR HEAD CHAIR

FIELD OF THE INVENTION

The present invention relates to sunshades in general, and in particular to collapsible sunshades designed for use with a headrest.

BACKGROUND OF THE INVENTION

As people become more aware of the harmful effects caused by overexposure to solar radiation, many are taking increased precautions to limit the amount of sun they receive. These precautions include wearing sunglasses, sunscreen, and protective clothing to reduce the chances of receiving a sunburn. One place where it is desirable to find shelter from the sun's rays is at the beach. The most common mechanism for providing such shelter is a collapsible umbrella. While umbrellas provide adequate protection from the sun's rays, they are usually heavy, bulky articles that are not very convenient or portable. Thus there is a need for a sunshade that can provide protection from the sun's rays, and is small enough to be placed in a handbag or a back pack and carried by a user.

SUMMARY OF THE INVENTION

The present invention is a collapsible sunshade that can be easily transported and set up by a user. The sunshade includes a pair of support arms coupled together at a first pivot point so that they can swing from a collapsed, generally parallel orientation to an open position in which they form an acute angle with each other. Each support arm has a lever arm that extends radially from the first pivot point. Disposed at an outer end of each support arm is a rib. The ribs are pivotally attached to respective support arms for swinging movement toward and away from the support arms. A fabric sheet is disposed between the ribs to form the sunshade. A pair of pushrods extend between the outer end of the respective lever arms at the bottom of the support arms and the respective ribs. When the support arms are moved from a closed position to an open position, the pushrods force the ribs to move outward from the support arms, thereby extending the sunshade.

The collapsible shade further includes a hinge mechanism coupled to the support arms so that the sunshade can be moved about an axis generally transverse to the first pivot point. A bracket is integrally formed with the hinge so that the sunshade can be secured to an object. Preferably, the bracket is a U-shaped device that can be slidably mounted to a pair of cross-bars in a collapsible headrest. Alternatively, the bracket may comprise a spring-biased or ratchet clamp that can secure the collapsible sunshade to virtually any object.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
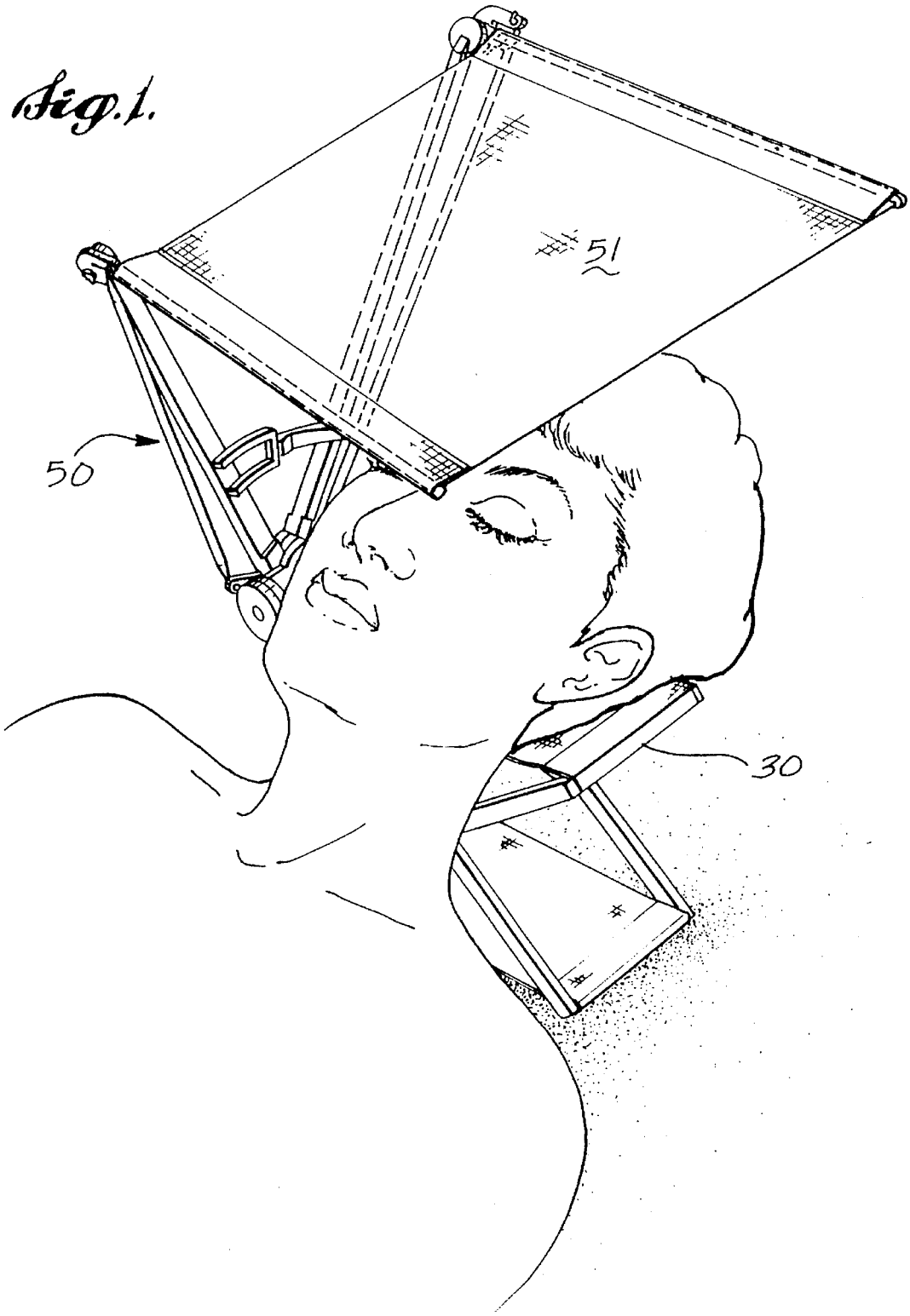
FIG. 1 is an environmental view of the collapsible sunshade according to the present invention.

Referring to FIG. 1, a sunshade 50 according to the present invention is preferably designed to be secured to a collapsible headrest 30, the details of which are fully set forth in U.S. Pat. No. 4,544,203, which is herein incorporated by reference. The collapsible shade 50 provides shelter from the sun's rays and is small enough to be placed in a handbag or back pack. The collapsible nature of the sunshade enables it to be easily transported by a user thereby allowing it to be used on a beach, at a park, or at any other location whereby it is desirable to limit one's exposure to the sun.

As will be described in further detail below, the user simply unfolds the headrest 30 and the collapsible sunshade 50 to provide a shaded head support. The user's head rests on a fabric panel at a height of approximately four inches from the surface on which the headrest is disposed. The position of the sunshade 50 can be adjusted by the user as the position of the sun changes.

Figure 2:
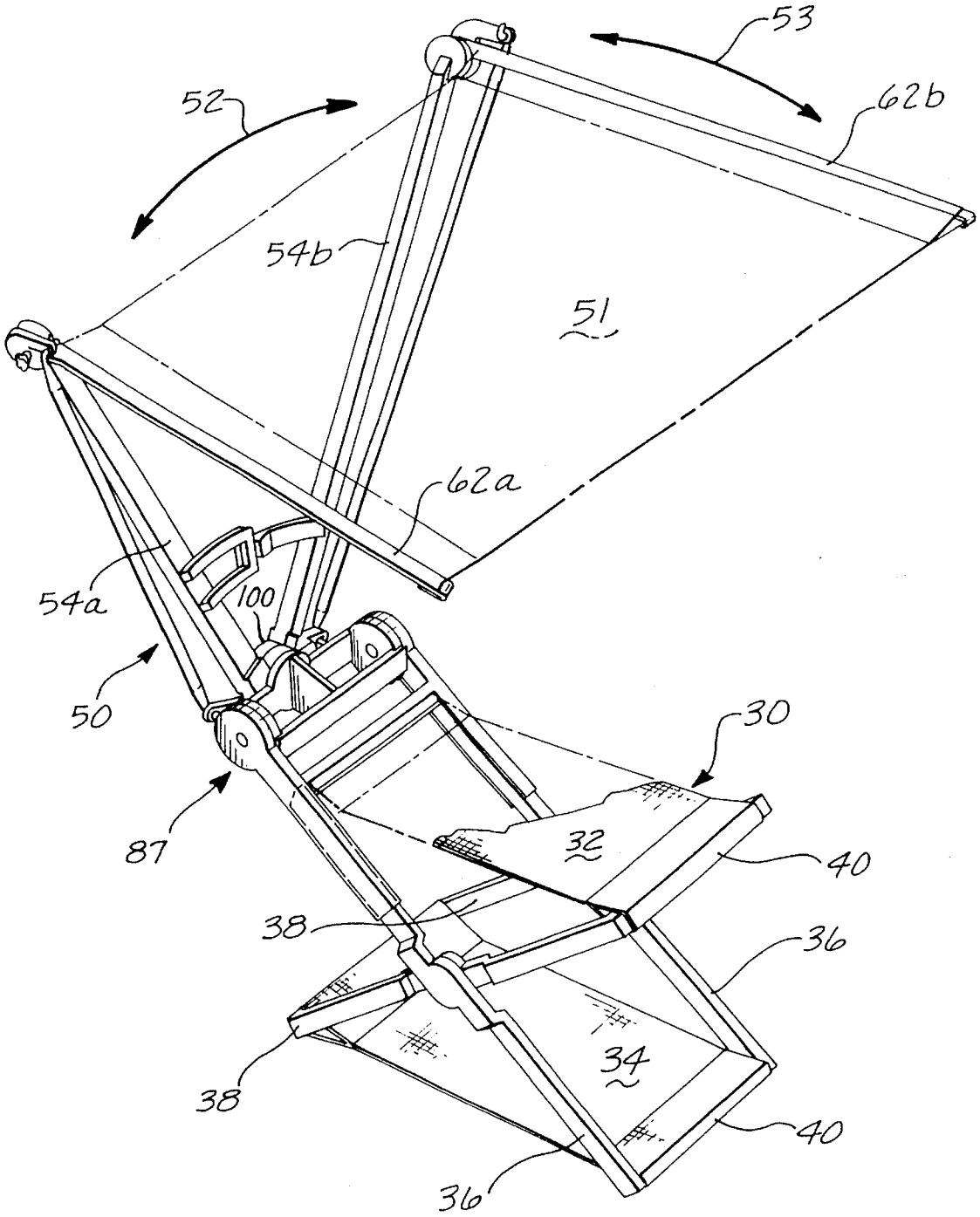
FIG. 2 is an isometric view of the collapsible sunshade according to the present invention.

Referring to FIG. 2, the headrest 30 includes two pairs of diagonal supports 36 and 38 pivotally joined at their center points. A plurality of cross members 40 join the ends of each of the diagonal supports to maintain the lateral distance between the diagonal members. A pair of flexible panels 32 and 34 are disposed over the top and bottom pairs of cross members to provide support for a user's head. When the diagonal members are collapsed to a generally parallel position, the headrest is sufficiently thin so that it can be easily transported. The flexible panels can be constructed from a fabric, a sheet of plastic material, or any other suitable material.

The sunshade 50 of the present invention is designed to be secured to one end of the opposing pairs of the diagonal members 36 of the headrest 30. The sunshade 50 can be rotated fore and aft in a direction indicated by arrow 52 towards or away from the user's chest. Additionally, the sunshade can be moved side to side in a direction indicated by arrow 53.

The sunshade 50 is not limited for use with a headrest. As will be described in further detail below, a second embodiment of the sunshade 50 can be clamped to any suitable object. One use for such a sunshade is on a baby carriage, child's car seat, or lounge chair where it is desirable to prevent the sun's rays from hitting a person's face. The advantage of the sunshade according to the present invention is that it is small enough to be transported anywhere, yet still provides adequate protection from the sun's damaging ultraviolet rays.

Still referring to FIG. 2, the collapsible sunshade is designed to mate with the corresponding headrest as shown in the '203 patent. The collapsible sunshade 50 includes a pair of support arms **54*a* and 54*b* that support a flexible shade 51 above the headrest. The flexible shade 51 can be constructed from a fabric, a sheet of plastic material, or any other suitable material. The support arms are rotatably coupled at their lower end to relatively rotate about a pivot axis 100. The support arms can be moved by swinging about pivot axis 100 from a closed position whereby the support arms abut each other in a generally parallel manner, to an open position where the support arms intersect to form an acute angle with one another. Additionally, entire shade can be tilted forward and backwards about axis 100 in a direction indicated by arrow 52. The support arms are mounted on a hinge mechanism that allows the shade to be moved towards and away from the headrest in a direction indicated by arrow 53**, as will be described in greater detail below.

Figure 3:
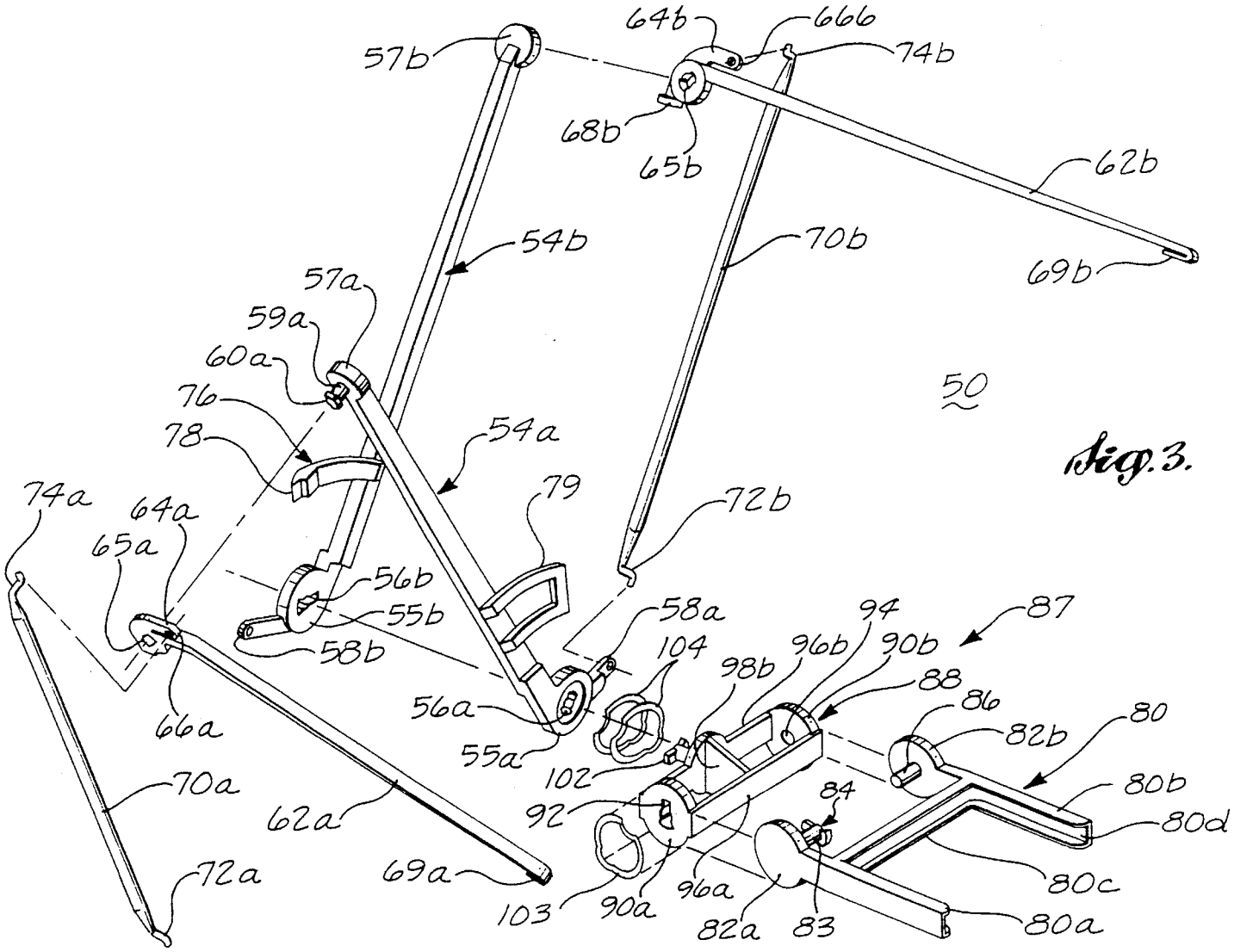
FIG. 3 is an exploded view of the collapsible sunshade according to the present invention.

Referring now to FIG. 3, the two support arms 54*a* and 54*b* are formed with a pair of disks at each end separated by an elongate section. At a lower end of the support arm 54*a* is a disk 55*a* having a keyway 56*a* disposed therein. A lever arm 58*a* extends radially outward from the bottom of the disk 55*a* so that in an operational position the outer end of the lever arm 58*a* is positioned below the upper end of opposing support arm 54*b*. At the lower end of the support arm 54*b* is a disk 55*b* with a keyway 56*b* disposed therein. A lever arm 58*b* extends radially outward from the bottom of the disk 55*b* so that in an operational position the outer end of lever arm 58*b* is positioned below the upper end of opposing support arm 54*a*.

At the top of each support arm is a second set of disks 57*a* and 57*b*. These disks are oriented at 90° from the orientation of the disks 55*a* and 55*b* at the lower end of the support arms. Disposed at the center of the disk 57*a* is an outwardly facing post 59*a* to which the rib 62*a* is rotatably attached. At the end of the post 59*a* is a key 60*a* that is used to secure the rib to the support arm. The disk 57*b* similarly includes a post having a key at the outer end thereof but is not separately shown.

Disposed at the top end of each support arm are a pair of ribs 62*a* and 62*b*. The rib 62*a* is disposed at the top end of the support arm 54*a* while the rib 62*b* is disposed at the top end of support arm 54*b*. The ribs 62*a* and 62*b* are designed to be rotatably secured to the top ends of the support arms 54*a* and 54*b*. The two ribs are mirror images of each other and therefore only the rib 62*b* will be discussed in detail. The rib has at its inner end a circular disk with a keyway 65*b* disposed therein. The keyway is designed to mate with the key 60*b* (not shown but the same as key 60*a*) in order to secure the rib to the support arm. Extending from the circular disk over the top of the rib and extending part way down the length of the rib is a lever arm 64*b* having a hole 66*b* disposed at its outer end. The lever arm 64*b* provides a mechanical advantage for a push rod to extend the rib outwardly from the support arms. A stop 68*b* extends from the rear of the circular disk on the rib. The stop extends inwardly toward the support arm and limits the outward swinging movement of the rib by engaging the rear of the support arm 54*b*. At the outer end of the rib is a hook 69*b* that prevents the flexible shade from sliding off the rib.

A pair of pushrods 70*a* and 70*b* couple the lever arms 58*a* and 58*b* on the support arms 54*a* and 54*b* to the lever arms 64*a* and 64*b* on the ribs 62*a* and 62*b*. The push rods 70*a* and 70*b* are long cylindrical elements having end portions that are designed to pivotally fit into the holes on the ends of lever arms 58*a*, 58*b*, 64*a*, and 64*b* and retain the pushrods in the lever arms. Each end portion comprises an integral pin oriented at a right angle to the pushrod. The end of each pin has a fight angle protrusion to retain the pin in the level arm hole after insertion. At the lower end of the pushrod 70*a* is an end portion 72*a* that mates with the hole at the end of the lever arm 58*b*. Similarly, the lower end of the pushrod 70*b* has an end portion 72*b* that mates with the lever arm 58*a*. At the top of the push rod 70*b* is an end portion 74*b* that extends inwards towards the rib 62*b* and mates with hole 66*b* at the outer end of the lever arm 64*b*. The end portion 74*a* at the top of the pushrod 70*a* similarly mates with the hole in the lever arm on the rib 62*a*.

As the support arms 54*a* and 54*b* are moved outwardly from their closed position, the lever arms 58*a* and 58*b* are moved upward, causing the pushrods 70*a* and 70*b* to move upward and extend the ribs 62*a* and 62*b* parallely outward and away from the support rods. The outward movement of the ribs 62*a* and 62*b* causes the sunshade to be extended to a position at nearly a right angle with the support arms.

A latch 76 having a lip 78 is disposed on an inner surface of the support arm 54*b* and extends toward opposing support arm 54*b*. A corresponding latch guide 79 is disposed to an inner surface of the support arm 54*a* and opposed to the latch 76. To secure the support arms in their open position, the support arms are positioned far enough apart so that the lip 78 on the latch 76 engages the outer end of the latch guide 79. In this position the latch mechanism holds the support arms in their open, angular orientation. To close the support arms, the lip is urged sidewardly out of contact with the latch guide so that the latch 76 can slide between the latch guide 79 as will be shown in detail below. The closing movement of the support arms 54*a* and 54*b* causes the lever arms 58*a* and 58*b* to be pulled downward. The downward movement is coupled to the ribs 62*a* and 62*b* through the pushrods 70*a* and 70*b*, swinging the ribs 62*a* and 62*b* downwardly toward the support arms as they are brought into parallel relationship, thereby collapsing the shade.

To allow movement of the shade in the direction indicated by the arrow 53 (shown in FIG. 2), the support arms are coupled to a hinge mechanism 87 as illustrated in FIG. 3. The hinge is comprised of a pair of outer plates 82*a* and 82*b* spaced in a generally parallel relationship. The outer plate 82*b* has a pin 86 extending inwardly toward the center of the hinge while the outer plate 82*a* has an inwardly extending pin 83. Disposed at the end of the pin 83 is a key 84. Between the outer plates 82*a* and 82*b* is a trunion 88 upon which the support arms 54*a* and 54*b* are rotatably secured. The trunion includes a pair of outer disks 90*a* and 90*b* that are maintained in a parallel spaced relationship by a pair of longitudinally extending side pieces 96*a* and 96*b*. A center support 98*b* maintains the lateral spacing between the side pieces 96*a* and 96*b* of the trunion. The disk 90*a* has a keyway 92 disposed at its center that cooperates with the key 84 on the end of pin 83. The disk 90*b* has a hole 94 disposed therein that mates with the pin 86. To secure the trunion within the hinge mechanism 87, the hole 94 in the disk 90*b* is slid over the inwardly extending pin 86. Next, a spring washer 103 is disposed between the disk 90*a* and the outer plate 82*a* in order to provide sufficient friction to the hinge mechanism so that the shade doesn't readily move after being positioned by a user. Finally, the trunion 88 is rotated so that the keyway 92 aligns with the key 84. The key 84 is slid through the keyway 84, and the trunion is then rotated, thereby securing the trunion with the hinge mechanism 87.

Although not clearly shown in FIG. 3, the center of the trunion has a key 102 extending outwardly from a supporting post upon which the support arms 54*a* and 54*b* are rotatably secured. The key 102 and its supporting post form the pivot axis 100 described above. Between the support arms and the trunion are two spring washers 104 that provide sufficient friction so that the support arms maintain their position after being set by a user. As an alternative to mounting the support arms on a single support post, it will be appreciated that each support arm could be mounted on its own support post in a closely spaced arrangement.

A bracket 80 secures the sunshade to the collapsible headrest. The bracket 80 includes a pair of oppositely facing, parallel arms 80*a* and 80*b*. A crossbar 80*c* maintains the lateral separation of the two arms 80*a* and 80*b*. An inner surface 80*d* of the bracket 80 is hollowed so that the bracket can slip over the diagonal support 36 and cross member 40 of the headrest 30 as shown in FIGS. 1 and 2. Preferably, the lateral distance between the outer plates 82*a* and 82*b* is slightly less than the length of the trunion 88. This causes the arms 80*a* and 80*b* of the bracket to be bent slightly towards each other, thereby providing a snug fit when the bracket 80 is fitted onto the headrest.

Figure 5:
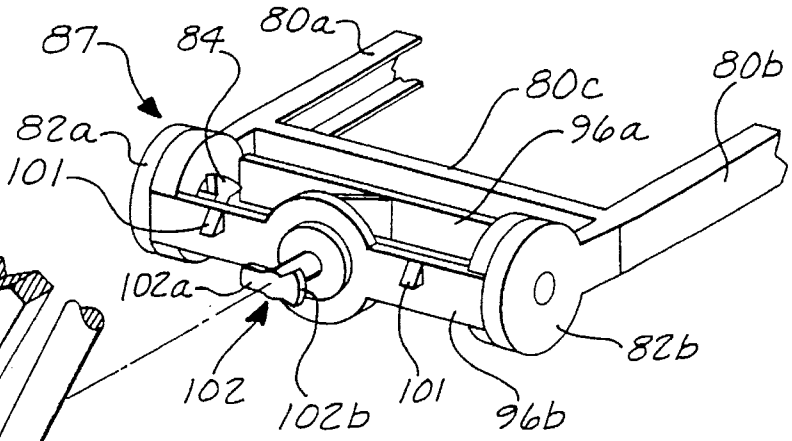
FIGS. 4 and 5 are isometric views showing how a hinge mechanism is secured to a pair of support arms that comprise the collapsible sunshade.
Figure 5:
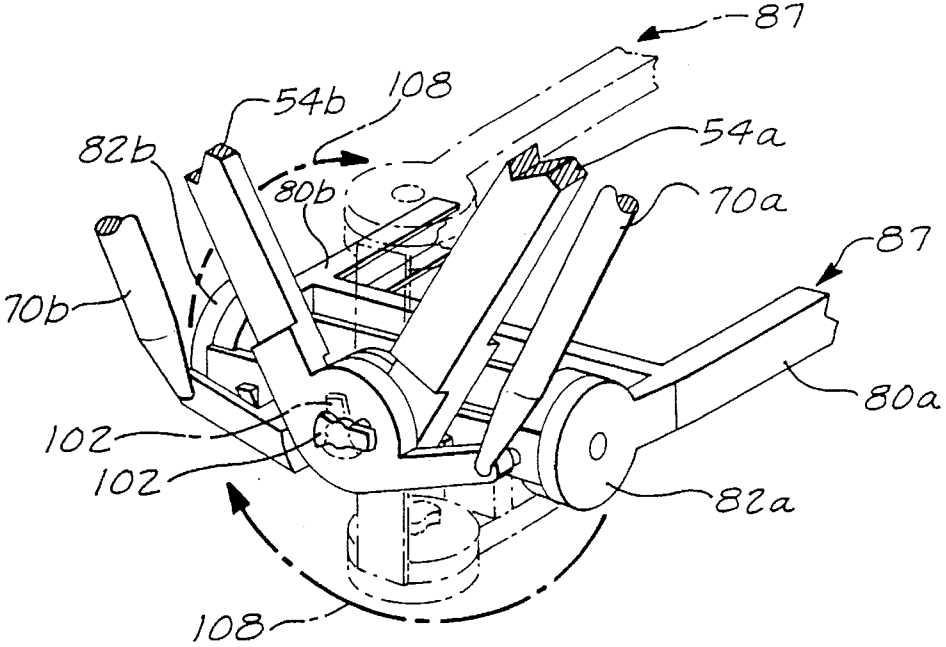
Figure 4:
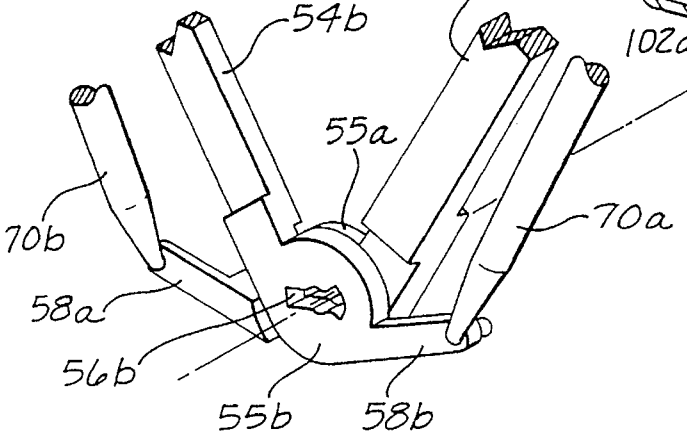

FIGS. 4 and 5 show how the support arms 54*a* and 54*b* are secured to the hinge. As indicated above, each support arm 54*a* and 54*b* includes a keyway 56*a* and 56*b* disposed in its lower end. The keyways ate designed to mate with the key 102 that extends outwardly from the trunion 88. The key 102 (and corresponding keyways) includes a straight portion 102*a* and a flared portion 102*b*. The length of the straight portion 102*a* as measured from the center of the key is longer than the length of the flared portion as measured from the center of the key. Furthermore, the width of the flared portion 102*b* is wider than the width of the straight portion 102*a*. As will be discussed below, this allows the key 102 to rotate over the keyways 56*a* and 56*b* without allowing the support arms to become detached from the hinge mechanism 87.

To secure the hinge 87 to the support arms 54*a* and 54*b*, the spring washers 104 (shown in FIG. 3) are placed over the key 102. The key 102 is then inserted through the aligned keyways 56*a* and 56*b*. The hinge mechanism 87 is then rotated 180° parallel to the support arms as indicated by the arrow 108 as shown in FIG. 5. The 180° rotation of the hinge mechanism 87 causes the key 102 to become unaligned with the keyways 56*a* and 56*b* disposed in the support arms. Therefore, the support arms are rotatably secured to the hinge mechanism. A pair of wedge-shaped stops 101 located on the side piece 96*b* of the trunion inhibit the fore and aft movement of the support arms by engaging the support arms when the shade has been tilted too far. Limiting the fore and aft movement of the support arms lessens the chance that the support arms and the hinge 87 will become disconnected.

In the presently preferred embodiment of the invention, the entire collapsible sunshade is made of a polycarbonate plastic that is injection molded. Polycarbonate plastics are desired material from which to make the sunshade due to its low cost and high strength. However, other plastic materials or metals could be used.

Figure 6:
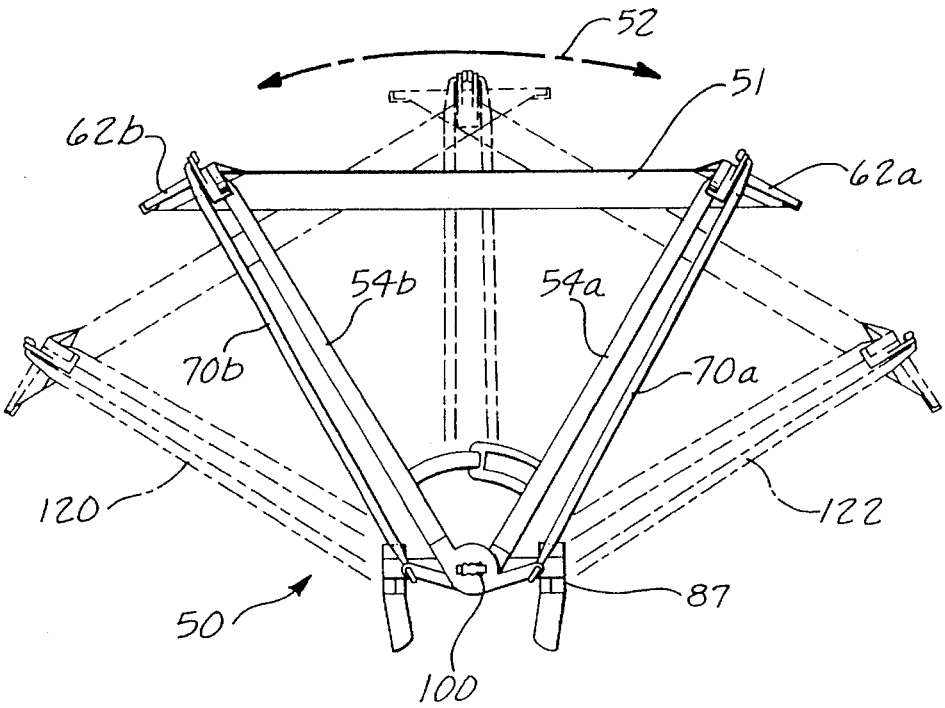
FIGS. 6 and 7 show how the sunshade can move on two different axes.
Figure 7:
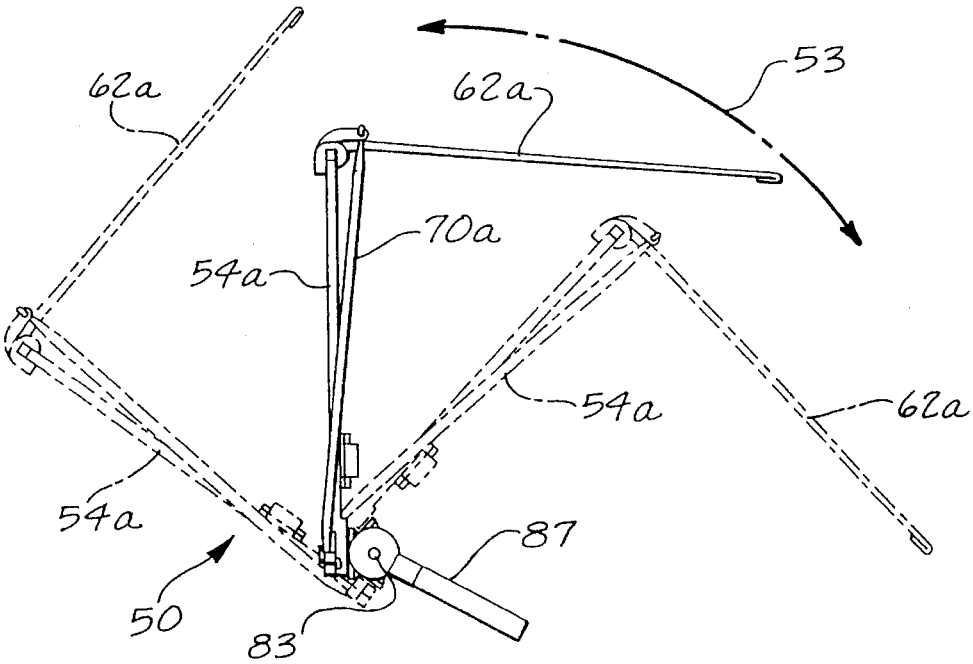

Movement of the sunshade in two perpendicular directions is shown in FIGS. 6 and 7. FIG. 6 shows how the shade can be rotated fore and aft about the pivot axis 100. From its center position, the shade can be rotated left to a position 120 or right to a position 122. As indicated above, the wedge-shaped stops 101 (shown in FIG. 4) on the trunion engage the inner surface of the support arms 54*a* and 54*b* to limit the fore and aft movement of the sunshade in the direction indicated by the arrow 52.

Referring now to FIG. 7, the sunshade can be moved side to side about the pin 83 in the direction indicated by the arrow 53. As the sunshade is moved, the relative position of the support arms and the ribs does not change.

Figure 8:
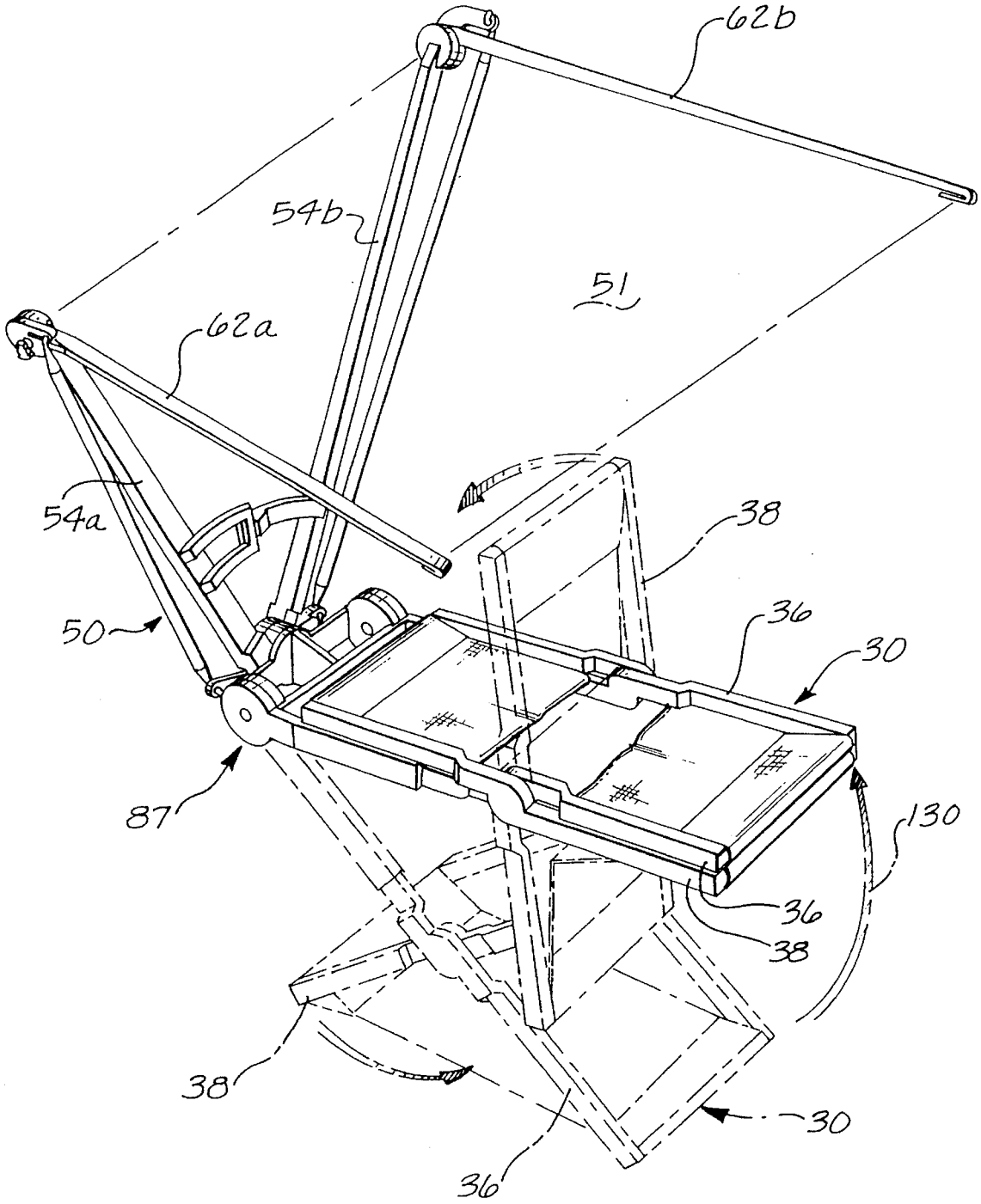
FIGS. 8–10 show how the sunshade according to the present invention is moved from an open to a fully collapsed position.
Figure 9:
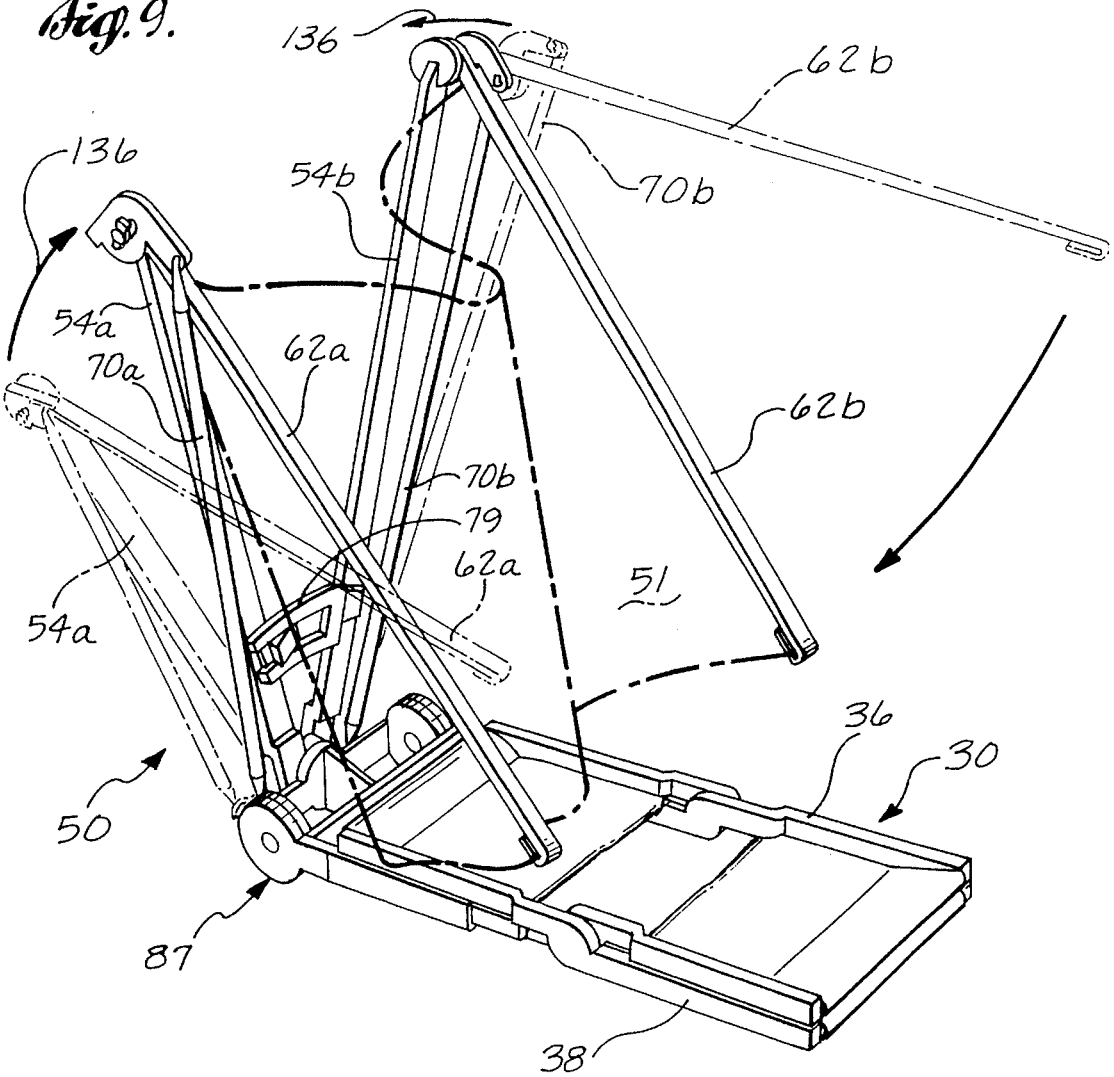
Figure 10:
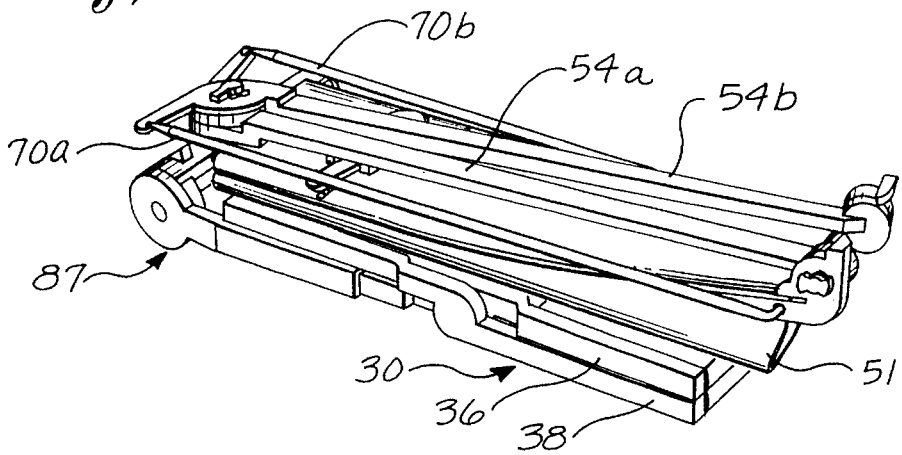

Referring now to FIGS. 8–10, the sunshade is collapsed in order to be stowed and transported by a user. Starting with FIG. 8, the headrest 30 is first collapsed from its open position (shown in phantom) to its closed position. First the diagonal support 38 of the collapsible headrest is rotated in a direction indicated by the arrow 130 to lie substantially parallel with the diagonal support 36. This causes the flexible panels 32 to collapse and lie between diagonal supports 36 and 38.

Turning now to FIG. 9, the support arms are unlatched by disengaging the lip 78 of the latch 76 from the outer end of the latch guide 79. The support arms 54*a* and 54*b* are then moved towards each other in a direction indicated by the arrow 136. As the arms are brought close together, the lever arms are pulled downward, thereby in turn pulling the pushrods 70*a* and 70*b* downward causing the outwardly extending ribs to collapse towards the supporting rods. As the ribs 62*a* and 62*b* are collapsed in a parallel relation to the support arms 54*a* and 54*b*, the flexible shade 51 slackens and can be folded.

FIG. 10 shows the sunshade fully collapsed. Once the support arms 54*a* and 54*b* have been brought together, the support arms 54*a* and 54*b* are folded over to lie substantially parallel with the folded headrest. As can be seen, the combination sunshade and headrest is compact and can be placed in a stuff sack or other carrying case. The combination of the collapsed sunshade and headrest is small enough to be placed in a handbag or back pack and carried to a beach or other area in which the user desires to shade him or herself from the sun's rays.

Figure 11:
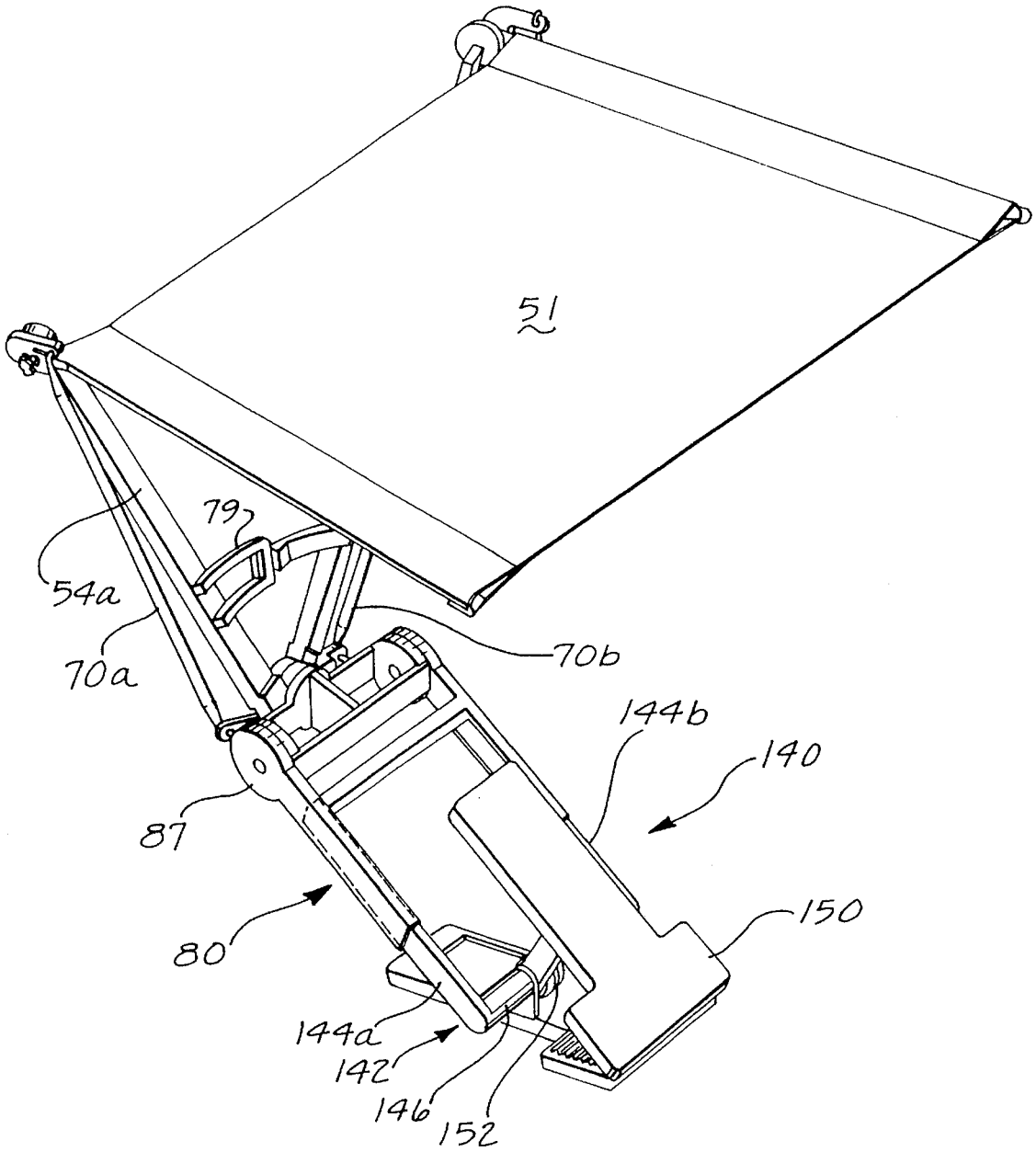
FIG. 11 shows a clamp accessory that is used to secure the sunshade to any suitable object.

Referring now to FIG. 11, a clamp accessory 140 allows the sunshade to be secured to any suitable object. The clamp accessory 140 includes a frame 142 that is composed of a pair of parallely extending arms 144*a* and 144*b* that slidably engage the parallel arms of bracket 80. A cross member 146 maintains the lateral spacing of the arms 144*a* and 144*b*. Coupled to the cross member 146 is a pair of opposing paddles 150 that are urged together by a spring 152. The spring loaded paddles 150 can be squeezed together and then released around an object to secure the sunshade to the object.

While the preferred embodiment of the invention has been illustrated and described, it will be appreciated that various changes can be made therein without departing from the spirit and scope of the invention. For example, as an alternative to making separately attachable ribs and support arms, the ribs and the support arms could be integrally formed with a thin plastic band joining the two pans. By making the band sufficiently flexible, the ribs can move relative to the support arms to extend the shade away from the support arms.

The embodiments of the invention in which an exclusive property or privilege is claimed are defined as follows:

1. A collapsible sunshade comprising:

a first and a second support arm rotatably coupled at their lower ends for swinging movement about a first axis, the first support arm including a first lever arm that extends radially from the first axis;

a first and second rib rotatably coupled to respective outer ends of the first and second support arms;

a flexible shade disposed between the first and second rib;

at least one pushrod having a first and a second end, the first end of the pushrod being coupled to the first lever arm and the second end coupled to the rib that is rotatably coupled to the second support arm;

wherein said first and second support arms are movable from a closed position in which the first and second support arms are in a substantially parallel relationship, to an open position in which the upper ends of the support arms are spaced from each other, the swinging movement of the first and second support arms from the closed to the open position causing the pushrod to move upwardly relative to the first and second support arm and raises the ribs so that the fabric shade is extended.

2. The collapsible sunshade of claim 1 wherein the second support arm further includes:

a second lever arm that extends radially from the first axis;

a second pushrod having a first and second end, the first end being coupled to the lever arm of the second support arm and the second end coupled to the rib rotatably coupled to the first support arm.

3. The collapsible sunshade of claim 1 further comprising a hinge coupled to the first and second support arms for moving the sunshade.

4. The collapsible sunshade of claim 1 further comprising means for securing the collapsible sunshade to an object.

5. The collapsible sunshade of claim 4 wherein the object to which the sunshade is to be secured is a headrest of the type including a collapsible frame having diagonal support members and one or more fabric panels secured to the support members, wherein the means for securing the collapsible sunshade comprises a bracket including a pair of parallely spaced arms coupled to the hinge portion, and adapted to receive a pair of diagonal support members of a headrest.

6. The collapsible sunshade of claim 4 wherein the means for securing the collapsible shade is a clamp.

7. In a foldable headrest of the type having a first opened and second folded position including a first molded integral one-piece rectangular frame having upper and lower parallel ends and connecting parallel side legs, a second molded integral one-piece rectangular frame having upper and lower parallel ends and connecting parallel side legs, said second rectangular frame being rotatably coupled to the first rectangular frame, a first fabric panel having two ends, one end being connected to said first frame upper end and the other end connected to said second frame upper end, a second fabric panel having two ends, one end being connected to said first frame lower end and the other end connected to said second frame lower end, and said panels being of a length so that when said frames are in said opened positions, said panels will be substantially taut; the improvement comprising a collapsible sunshade adapted to be secured to the headrest including:

a first and a second support arm rotatably coupled at their lower ends for swinging about a first axis, said first and second support arm being movable between a first position in which the first and second support arms are generally parallel to each other and a second position in which the first and second arm form an acute angle with respect to each other;

a first and second rib rotatably coupled to respective outer ends of the first and second support arm;

a flexible panel disposed between the first and second ribs;

means coupled to the first and second support arms for parallely extending the ribs from a position in which the first and second ribs lie generally parallel to the first and second support arms to a position in which the ribs are in a transverse relationship to the support arms as the support arms are moved from the first position to the second position; and means for securing the collapsible sunshade to the foldable headrest.

8. The foldable headrest of claim 7, wherein the means for parallely extending the ribs comprise:

at least one lever arm coupled to the first support arm and extending radially from the first axis; and a pushrod having a first end coupled to the lever arm and a second end coupled to the rib that is disposed at the end of the second support arm.

9. The foldable headrest of claim 8 wherein the means for parallely extending the ribs further comprise:

a second lever arm coupled to the second support arm and extending radially from the first axis point; and a second pushrod having a first end coupled to the second lever arm and a second end coupled to the rib disposed at the end of the first support arm.

10. The foldable headrest of claim 7, when the means for securing the collapsible sunshade to the foldable headrest further comprises means for securing the sunshade to the first rectangular side frame.

11. In a foldable headrest of the type having a first opened and second folded position including a first molded integral one-piece rectangular frame having upper and lower parallel ends and connecting parallel side legs, a second molded integral one-piece rectangular frame having upper and lower parallel ends and connecting parallel side legs, said second rectangular frame being rotatably coupled to the first rectangular frame, a first fabric panel having two ends, one end being connected to said first frame upper end and the other end connected to said second frame upper end, a second fabric panel having two ends, one end being connected to said first frame lower end and the other end connected to said second frame lower end, and said panels being of a length so that when said frames are in said opened positions, said panels will be substantially taut; the improvement comprising a collapsible sunshade adapted to be secured to the headrest including:

a first and a second support arm rotatably coupled at their lower ends for swinging about a first axis;

a first and second rib rotatably coupled to respective outer ends of the first and second support arm;

a flexible panel disposed between the first and second ribs;

means for parallely extending the ribs in a transverse relationship to the support arms that includes a) at least one lever arm coupled to the first support arm and extending radially from the first axis; and b) a pushrod having a first end coupled to the lever arm and a second end coupled to the rib that is disposed at the end of the second support arm; and means for securing the collapsible sunshade to the foldable headrest.

12. The foldable headrest of claim 11 wherein the means for parallely extending the ribs further comprise:

a) a second lever arm coupled to the second support arm and extending radially from the first axis point; and b) a second pushrod having a first end coupled to the second lever arm and a second end coupled to the rib disposed at the end of the first support arm.

13. The foldable headrest of claim 11, wherein the means for securing the collapsible sunshade to the foldable headrest further comprises means for securing the sunshade to the first rectangular side frame.

14. A collapsible sunshade comprising:

securing means for connecting the sunshade to an object;

a trunion rotatably connected to the securing means, the trunion including an outwardly extending post and a key disposed at an end of the post, the key having a first end with a first shape and a second end with a second shape different from the first shape;

a pair of support arms having a flexible shade secured thereto, each support arm having a keyway, the keyway being adapted to cooperate with the key disposed at the end of the post; and one or more spring washers disposed over the post;

wherein the support arms are secured to the trunion by passing the key through the keyways and rotating the key with respect to the keyways.

15. The collapsible sunshade of claim 14, wherein the first end of the key has a length that is longer than a length of the second end of the key and wherein the second end of the key has a width that is wider than a width of the first end of the key.

* * * * *